US012233508B2

(12) United States Patent
Chen et al.

(10) Patent No.: US 12,233,508 B2
(45) Date of Patent: Feb. 25, 2025

(54) DEVICE FOR PRECISION MACHINING OF SPHERE, AND METHOD FOR PRECISION MACHINING OF SPHERE USING SAME

(71) Applicant: JIANGSU UNIVERSITY, Zhenjiang (CN)

(72) Inventors: Lan Chen, Zhenjiang (CN); Xinzhou Zhang, Zhenjiang (CN); Zhiwei Yang, Zhenjiang (CN); Linkai Lu, Zhenjiang (CN); Guanxi Yu, Zhenjiang (CN); Xudong Ren, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 0 days.

(21) Appl. No.: 18/686,872

(22) PCT Filed: Apr. 27, 2023

(86) PCT No.: PCT/CN2023/091248
§ 371 (c)(1),
(2) Date: Feb. 27, 2024

(87) PCT Pub. No.: WO2024/207574
PCT Pub. Date: Oct. 10, 2024

(65) Prior Publication Data

US 2024/0335921 A1 Oct. 10, 2024

(30) Foreign Application Priority Data

Apr. 6, 2023 (CN) ..... 202310361741.1

(51) Int. Cl.
*B24B 31/116* (2006.01)
*B24B 31/00* (2006.01)
(Continued)

(52) U.S. Cl.
CPC ..... *B24C 3/32* (2013.01); *B24B 31/00* (2013.01); *B24B 31/116* (2013.01); *B24C 1/08* (2013.01); *B24C 9/00* (2013.01)

(58) Field of Classification Search
CPC ..... B24B 31/00; B24B 31/067; B24B 31/10; B24B 31/104; B24B 31/112;
(Continued)

(56) References Cited

U.S. PATENT DOCUMENTS 5,125,191 A * 6/1992 Rhoades ..... B24B 31/116 451/36
6,273,787 B1 * 8/2001 Gilmore ..... C09G 1/02 451/36
9,687,953 B2 * 6/2017 Sun ..... B24B 5/40
10,065,289 B2 * 9/2018 Chinnakaruppan ..... B24C 3/32
(Continued)

FOREIGN PATENT DOCUMENTS

CN 102170999 A 8/2011
CN 105108632 A 12/2015
(Continued)

*Primary Examiner* — Eileen P Morgan
(74) *Attorney, Agent, or Firm* — Bayramoglu Law Offices LLC

(57) ABSTRACT

A sphere precision machining device and a machining method comprise a cavity, an abrasive grain stream, and a circulation device. The cavity holds the workpiece, and comprises two hollow hemispheres, each of said two hemispheres being provided with a main flow channel. Said main flow channel is connected to the cavity. One end of the main flow path of each of the two said hemispheres is connected to a circulating means by which a stream of abrasive grains is made to grind the workpiece. A plurality of main flow channels are disposed homogeneously inside the hemisphere, each of said main flow channels being provided with a plurality of branch flow channels connected to the cavity, said branch flow channels tapering in the flow direction. The
(Continued)

present disclosure uses the difference in abrasive grain flow pressure on the surface of the workpiece to achieve precision machining.

4 Claims, 3 Drawing Sheets

(51) Int. Cl.
*B24C 1/08* (2006.01)
*B24C 3/32* (2006.01)
*B24C 9/00* (2006.01)

(58) Field of Classification Search
CPC ..... B24B 31/116; B24B 31/12; B24B 31/16; B24C 1/08; B24C 3/22; B24C 3/32; B24C 9/00
USPC ..... 451/5, 32, 34, 35, 60, 74, 113, 326
See application file for complete search history.

(56) References Cited

U.S. PATENT DOCUMENTS

| | | | | |
|---|---|---|---|---|
| 11,577,355 | B2 * | 2/2023 | De Silva | B24B 31/116 |
| 2008/0271380 | A1 | 11/2008 | Yan et al. | |

FOREIGN PATENT DOCUMENTS

| | | | |
|---|---|---|---|
| CN | 206305962 | U | 7/2017 |
| CN | 108161754 | A | 6/2018 |
| CN | 109986455 | A | 7/2019 |
| JP | H02190251 | A | 7/1990 |
| JP | 2008238360 | A | 10/2008 |

* cited by examiner

DEVICE FOR PRECISION MACHINING OF SPHERE, AND METHOD FOR PRECISION MACHINING OF SPHERE USING SAME

CROSS REFERENCE TO RELATED APPLICATION

This application is a national stage entry of International Application No. PCT/CN2023/091248, filed on Apr. 27, 2023, which is based upon and claims foreign priority to Chinese Patent Application No. 202310361741.1, filed on Apr. 6, 2023, the entire contents of which are incorporated herein by reference.

TECHNICAL FIELD

The present disclosure relates to the field of special machining, and particularly to a sphere precision machining device and a machining method.

BACKGROUND

High-precision ball has high requirements on the shape accuracy, surface quality and consistency of the ball, which has a very critical impact on the production of high-end basic components such as high-precision linear guides, high-precision ball screws, high-performance bearings and high-precision optical devices. It will affect the overall accuracy of the precision components, and even cause damage to other components, ultimately affecting the service life of the overall equipment.

SUMMARY

In view of the deficiencies in the prior art, the present disclosure provides a sphere precision machining device and a machining method. By placing the workpiece in a sealed circular cavity and passing a stream of abrasive particles into the circular cavity. The circular cavity is equipped with a main flow channel for the circular flow of abrasive grain flow, the main flow channel is equipped with sub-branching channels, the abrasive grain flow is contacted with the workpiece through the sub-branching channels and the workpiece surface bumps are processed for precision grinding.

The present disclosure achieves the above technical object by the following technical means.

A sphere precision machining device comprising a cavity, an abrasive grain stream and a circulation device. The cavity holds the workpiece, said cavity comprising two hollow hemispheres. A main flow channel is provided in each of the two said hemispheres, said main flow channel being in communication with the cavity. One end of the main flow path of each of the two said hemispheres is connected to a circulating means by which a stream of abrasive grains is made to grind the workpiece.

Further, a plurality of main flow channels are disposed homogeneously inside the hemisphere, each of said main flow channels being provided with a plurality of branch flow channels connected to the cavity, said branch flow channels tapering in the flow direction.

Further, an axis of said branch runners is at an angle of 20° to 45° in the direction of the radius in which they are located.

Further, a sealing assembly is provided between the mating surfaces of the two said hemispheres for sealing.

Further, control systems, vibration sensors and pressure sensors are also included, where a number of said vibration sensors are mounted on the inner wall of the cavity for detecting vibration signals generated by the abrasive grain flow, said pressure sensor is configured to detect the pressure of the abrasive grain flow output from the circulation device, said control system regulates the output pressure of the circulation device according to the vibration signal.

A method of processing a sphere precision machining device as described, including the steps of:

placing the workpiece into the cavity and install the hemisphere seal, pumping the abrasive stream into the cavity for grinding of the workpiece by means of a circulation device, detecting, by a number of vibration sensors, the vibration signals generated by the abrasive grain flow, and regulating, by the control system, the output pressure of the circulation device according to the vibration signals, and after the grinding process is completed, taking out the workpiece to check whether the shape accuracy and surface quality meet the set requirements, if not, putting the workpiece back into the cavity for processing.

Further, said control system regulates the output pressure of the circulation device in accordance with the vibration signal, specifically including:

as an initial state, setting the output pressure of the circulation device to $P_0$;

after processing for a time $t_1$, comparing, by said control system, the average value $S_{t1}$ of a number of vibration signals with a first set value according to the average value Su of the number of vibration signals, where when the average value Su is less than the first set value, completing the grinding processing;

when the average value Su is greater than the first set value, increasing, by said control system, the output pressure of the circulation device to $P_1$; after adjusting the pressure and processing for a time $t_2$, when the average value $St_2$ is greater than the first set value and the average value $St_2$ is less than the average value $S_{t2}$, reducing, by said control system, the output pressure of the circulation device to $P_2$, where $P_1>P_2>P_0$, until the average value Su is less than the first set value.

The beneficial effects of the present disclosure are:

1. The sphere precision machining device and the machining method described in the present disclosure achieve precision machining of a high-precision sphere by sealing two hemispheres. The axes of abrasive flow inlet hole and abrasive flow return hole are designed to make an angle of 20°-45° to the radius direction where they are located, so that the abrasive flow drives the workpiece to rotate in counterclockwise direction. Precision machining using the difference in abrasive flow pressure on the surface of the workpiece can effectively improve the shape accuracy of the workpiece.
2. The sphere precision machining device and the machining method described in the present disclosure use changes in vibration signals to detect the machining state of the workpiece. At the beginning of machining, due to the uneven surface of the workpiece, the pressure on the raised part of the workpiece is high, the cutting effect of the abrasive flow on the raised part is increased, and the vibration in the machining unit will be high. When all the projections on the workpiece are removed, the workpiece gradually turns into a precise sphere shape and the vibration inside the machining unit gradually decreases. The control system decides whether the machining of the workpiece is completed or not based on the judgement of the vibration signal. The use of this inspection method effectively reduces the number of actual measurements of the workpiece during machining and improves productivity.

BRIEF DESCRIPTION OF THE DRAWINGS

In order to illustrate more clearly the technical solutions in the embodiments or prior art of the present disclosure, the accompanying drawings, which are to be used in the description of the embodiments or prior art, will be briefly described below. The accompanying drawings in the following description are some embodiments of the present disclosure. It will be obvious to a person of ordinary skill in the art that other drawings can be obtained from these drawings without creative labour.

In the figures.

Figure 1:
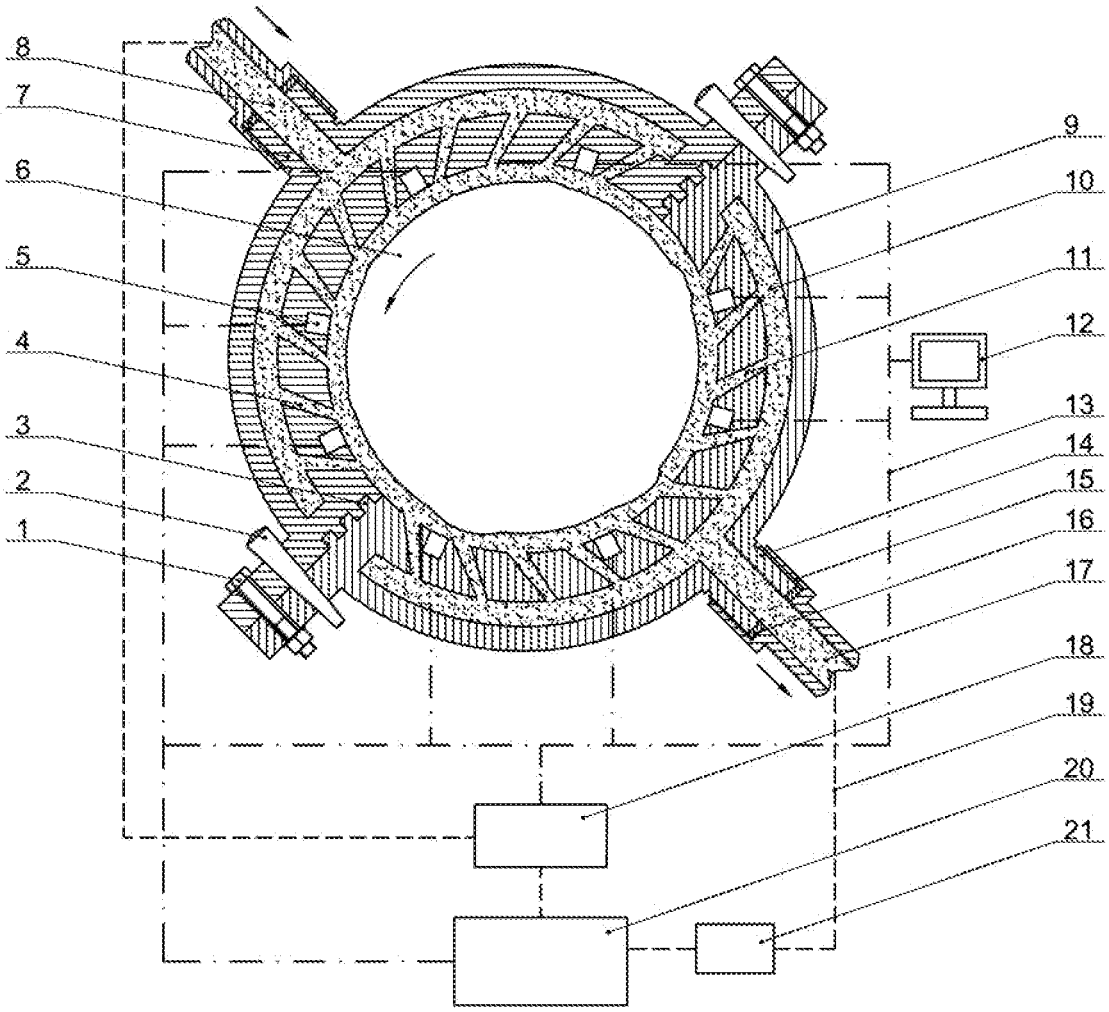
FIG. 1 shows a sectional view of the sphere precision machining device described in the present disclosure.

1—bolt connector, 2—positioning pin, 3—serrated sealing structure, 4—abrasive grain flow inlet hole, 5—vibration sensor, 6—workpiece, 7—first hemisphere, 8—abrasive grain flow inlet, 9—second hemisphere, 10—abrasive stream, 11—abrasive stream return hole, 12—control system, 13—signal line, 14—pipe fitting thread, 15—connecting pipe, 16—sealing washer, 17—abrasive stream outlet, 18—pressure pump, 19—abrasive stream conveying pipe, 20—abrasive stream recycling device, 21—pressure valve, 22—workpiece protruding place, 23—workpiece flat place.

DETAILED DESCRIPTION OF THE EMBODIMENTS

The present disclosure is further described below in connection with the accompanying drawings and specific embodiments, but the scope of protection of the present disclosure is not limited thereto.

Embodiments of the present disclosure are described in detail below, and examples of said embodiments are shown in the accompanying drawings, wherein the same or similar labels throughout indicate the same or similar elements or elements having the same or similar functions. The following embodiments described by reference to the accompanying drawings are exemplary and are intended for use in explaining the present disclosure and are not to be construed as a limitation of the invention.

In the description of the present disclosure, it is to be understood that the terms "centre", "longitudinal", "transverse", "length", "width", "thickness", "top", "bottom", "axial", "radial", "vertical", "horizontal", "inner", "outer" and the like indicate orientation or positional relationships based on those shown in the accompanying drawings, and are only for the purpose of facilitating the description of the present disclosure and of simplifying the description and are not indicative of, or implied to indicate, that a device or element referred to must be of a particular orientation, be constructed and operated with a particular orientation and are not to be construed as limitations to the invention. Furthermore, the terms "first" and "second" are used for descriptive purposes only and are not to be understood as indicating or implying relative importance or implicitly specifying the number of technical features indicated. Thus, a feature defined with the terms "first", "second" may expressly or implicitly include one or more such features. In the description of the present disclosure, "more than one" means two or more, unless otherwise expressly and specifically limited.

In the present disclosure, unless otherwise expressly provided and limited, the terms "mounted", "connected", "connected", "fixed", etc. are to be understood in a broad sense. "and the like are to be understood in a broad sense, for example, as a fixed connection, a detachable connection, or a connection in one piece; a mechanical connection or an electrical connection; a direct connection or an indirect connection through an intermediate medium; or a connection within two elements. For a person of ordinary skill in the art, the specific meaning of the above terms in the present disclosure may be understood on a case-by-case basis.

Figure 2:
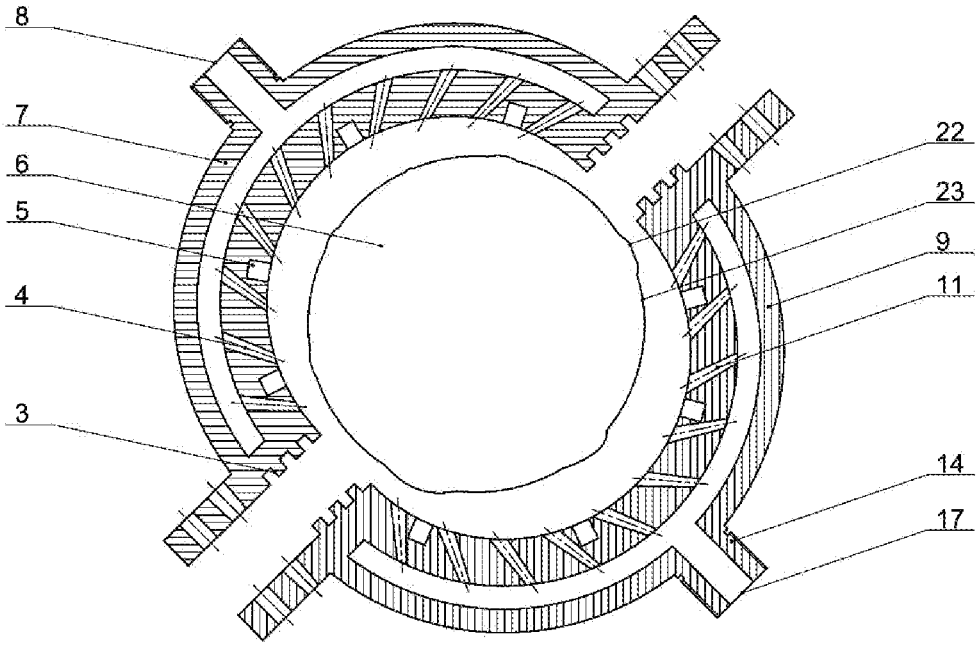
FIG. 2 shows an exploded view of the sphere precision machining device described in the present disclosure.

As shown in FIG. 1 and FIG. 2, the sphere precision machining device described in the present disclosure comprises a circular cavity, an abrasive grain stream 10 and a circulation device. The said circular cavity is configured to hold the workpiece 6 to be machined. The said circular cavity comprises two hollow hemispheres, a first hemisphere 7 and a second hemisphere 9, which being connected to each other by means of a sealing device. The said sealing means comprises a locating pin 2, a bolted connector 1 and a serrated sealing structure 3 located at the union of the first hemisphere 7 and the second hemisphere 9. Locating the connection between the first hemisphere 7 and the second hemisphere 9 by means of said locating pin 2, said locating pin 2 being a conical pin, which ensures the precision of the positioning of the first hemisphere 7 and the second hemisphere 9 and ensures that the first hemisphere 7 and the second hemisphere 9 form a precision spherical space. Said serrated sealing structure 3 ensures that no leakage occurs when the first hemisphere 7 is connected to the second hemisphere 9. Finally, a sufficiently high connection strength is ensured by means of said bolting member 1 when the first hemisphere 7 is connected to the second hemisphere 9.

Said first hemisphere 7 is provided with an abrasive grain flow inlet 8 and said second hemisphere 9 is provided with a grit stream outlet 17. Said first hemispherical body 7 is provided with a first main flow channel, the first main flow channel being connected to the abrasive grain flow inlet 8 and the cavity, respectively. Said second hemisphere 9 is provided with a second main flow channel, the second main flow channel being connected to the abrasive grain flow outlet 17 and the cavity. Said abrasive grain stream 10 forms a circulation loop between the abrasive grain stream inlet hole 4, the circular cavity and the abrasive grain stream outlet 17 by means of a circulation device. The first main flow path and the second main flow path are not connected to each other, and each of said first main flow paths is provided with a number of abrasive grain flow inlet holes 4 connected to the cavity. Said abrasive grain flow inlet hole 4 tapers in the flow direction. Each said second main flow path is provided with a number of abrasive flow return holes 11 connected to the cavity, said abrasive flow return holes 11 tapering in the flow direction. In the embodiment the abrasive grain flow inlet hole 4 and the abrasive grain flow return aperture 11 are conical apertures, respectively. Said abrasive grain flow inlet holes 4 and abrasive grain flow return holes 11 can direct the flow direction of the abrasive grain flow 10, and collectively are branched flow channels. The axis of each of said abrasive flow inlet holes 4 and abrasive flow return holes 11 form an angle of 20° to 45° in the direction of the radius in which they are located. Such a setting enables the abrasive grain stream 10 to drive the workpiece 6 to make a counterclockwise rotation, thereby removing the workpiece projections 22 of the workpiece 6 by precision machining of the workpiece projections 22 on the surface of the workpiece 6 by the abrasive grain stream 10. The axes of both the preferred abrasive flow inlet hole 4 and the abrasive flow return aperture 11 form an angle of 35° with the radius direction in which they are located.

Said circulating means comprising an abrasive stream delivery pipe 19, a pressure pump 18, an abrasive stream recovery device 20 and a pressure valve 21. The abrasive grain stream outlet 17 of said second hemispherical body 9 is connected to an abrasive grain stream recovery device 20 via an abrasive grain stream delivery pipe 19. The abrasive grain stream recovery device 20 being connected to the inlet of a pressure pump 18. Said abrasive stream recovery unit 20 is configured to recover the filtered abrasive stream 10. Said pressure pump 18 outlet being connected to said abrasive grain flow inlet 8 of said first hemisphere 7. Said abrasive grain stream outlet 17 is fitted with a pressure valve 21 for determining the pressure of the abrasive grain stream 10. The abrasive stream 10 flowing from said abrasive stream outlet 17 passes through a pressure valve 18 into an abrasive stream recovery device 20. Said abrasive stream recovery device 20 recycles and filters the abrasive stream 10 and continues to be conveyed by the pressure pump 18 to the abrasive grain flow inlet 8. Said abrasive grain stream 10 circulates in the circular cavity under the action of the pressure pump 18 and continuously performs precision machining on the surface of the workpiece 6. Said abrasive grain stream inlet 4 and abrasive grain stream outlet 17 are provided with duct seals. Said pipe sealing means comprising a pipe fitting thread 14, a connecting pipe 15 and a sealing washer 16. Taking the grit stream outlet 17 as an example, said pipe fitting thread 14 is provided on the grit stream outlet 17, said connecting pipe 15 is threaded onto the grit stream outlet 17, and a sealing washer 16 is passed between said connecting pipe 15 and the grit stream outlet 17 for improving sealing performance.

Said circulation system is also connected to a control system 12, wherein said control system 12 can determine the value of the flow pressure of the abrasive grain stream 10 according to the machining allowance of the workpiece 6 to be machined, prior to the commencement of the precision machining work. While the precision machining work is in progress, said control system 12 is further connected to vibration sensors 5 provided on the inner walls of the first hemisphere 7 and the second hemisphere 9. Said vibration sensor 5 is connected to the control system 12 by means of a signal line 13, and according to the different vibration signals of the abrasive grain stream 10 at the workpiece protrusion 22 and the workpiece levelling 23, the completion of the precision machining of the workpiece 6 is judged by the smoothness of the signals transmitted from the vibration sensor 5, and thus the value of the flow pressure of the abrasive grain stream 10 is adjusted by means of the control system 12. Said control system 12 regulates the output pressure of the circulation device according to the vibration signal. If the workpiece 6 has completed the precision machining, the control system 12 automatically and gradually reduces the value of the flow pressure of the abrasive grain stream 10 to 0 by means of the pressure pump 18. In addition, the abrasive grains of said abrasive grain stream 10 can be processed in a wide range of metallic and non-metallic spheres by determining the material, grain size, etc. of the abrasive grain stream 10 according to the material and properties of the workpiece 6.

Figure 3:
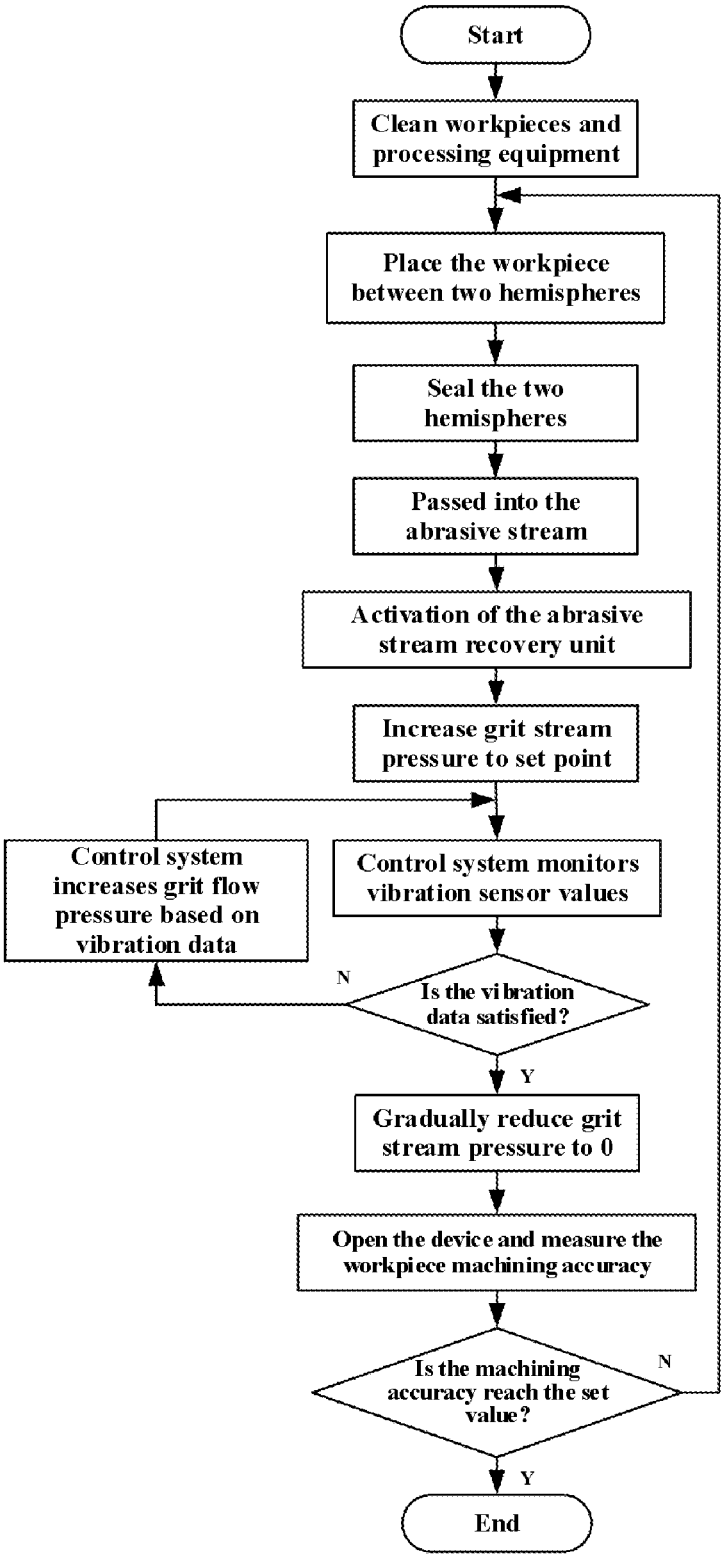
FIG. 3 shows a flow chart of a processing method of the sphere precision machining device described in the present disclosure.

Taking high-precision bearing steel balls as an example, the method of the ball precision machining device described in the present disclosure, as shown in FIG. 3, comprises the following steps:

According to the requirements of the processed high-precision bearing steel balls, 4000 #grain size $Al_2O_3$ abrasive grains are selected, and the abrasive grain flow pressure is 0.04-0.1 MPa. The first setting value of 0.01 mm/s is determined according to the material properties.

The workpiece 6 to be processed and the entire unit are cleaned.

The workpiece 6 is placed into the circular cavity and the connection between the first hemisphere 7 and the second hemisphere 9 is positioned by means of the positioning pin 2. The serrated sealing structure 3 ensures that no leakage occurs when the first hemisphere 7 and the second hemisphere 9 are connected. The bolted connector 1 ensures that the first hemisphere 7 and the second hemisphere 9 can have a sufficiently high connection strength when connected. Bolt tightening torque: 3.5 N·m.

An abrasive grain stream 10 is passed into the circular cavity and the circulation device is switched on so that the abrasive grain stream 10 can flow continuously in the circular cavity to perform precision machining of the workpiece 6. The initial state sets the circulation device output pressure $P_0$ to 0.04 MPa.

A number of vibration sensors 5 detect vibration signals generated by the abrasive grain stream 10, and the control system adjusts the output pressure of the circulation device according to the vibration signals, specifically:

After a processing time of 20 minutes, said control system 12 compares the average value St of a number of vibration signals with a first set value, the first set value being taken as 0.01 mm/s, and when the average value Su is less than 0.01 mm/s, the grinding process is completed.

When the average value Su is greater than 0.01 mm/s, the control system 12 increases the output pressure of the circulating means to $P_1$=0.06 MPa. After 20 minutes time of processing after adjusting the pressure, when the average value $S_{t2}$ is greater than 0.01 mm/s and the average value $S_{t2}$ is less than the average value Su, then said control system reduces the output pressure of the circulating device to $P_2$=0.05 MPa and $P_1>P_2>P_0$, until the average value $S_{t1}$ is less than the first set value. And as shown in Table 1, the control system 12 determines the size of the output pressure of the adjusting circulation device based on the average value S of the vibration signal.

After the grinding process is completed, the workpiece 6 is taken out to detect whether the shape accuracy and surface quality meet the set requirements, if not, it is put back into the cavity for processing.

Open the first hemisphere 7 and the second hemisphere 9, take out the workpiece, measure the workpiece 6, and if the accuracy of the workpiece 6 does not meet the requirements, continue to put it into the circular cavity for machining.

TABLE 1

| Average value of vibration signals (mm/s) | Pressure pump values (MPa) |
|---|---|
| <0.01 | No adjustment required |
| 0.01-0.02 | 0.05 |
| 0.02-0.03 | 0.06 |
| 0.03-0.04 | 0.07 |

TABLE 1-continued

| Average value of vibration signals (mm/s) | Pressure pump values (MPa) |
|---|---|
| 0.04-0.05 | 0.08 |
| 0.06-0.07 | 0.09 |
| >0.07 | 0.1 |

It should be understood that although this specification is described in accordance with various embodiments, not each embodiment contains only one independent technical solution, and this description of the specification is only for the sake of clarity, and the person skilled in the art should take the specification as a whole, and the technical solutions in the various embodiments can be combined appropriately to form other embodiments that can be understood by the person skilled in the art.

The above listed series of detailed description is only for the feasible embodiments of the present disclosure, they are not intended to limit the scope of protection of the present disclosure, all not out of the spirit of the art of the present disclosure equivalent embodiments or changes should be included in the scope of protection of the present disclosure.

What is claimed is:

1. A sphere precision machining device, comprising:

a cavity, an abrasive grain stream, and a circulation device, wherein the cavity holds a workpiece, the cavity consists of two hollow hemispheres, and the two hemispheres are each provided with a main flow channel, the main flow channels being connected to the cavity;

one end of a main flow path of each of the two hemispheres is connected to a circulating device, and by means of the circulating device, a stream of abrasive grains grinds the workpiece; and the main flow channels are disposed homogeneously inside the hemispheres, and each of the main flow channels are provided with a plurality of branched flow channels connecting to the cavity, the branched flow channels being tapered in a flow direction.

2. The sphere precision machining device according to claim 1, wherein an axis of the branched flow channels are at an angle of 20° to 45° to a radius direction in which they are located on the main flow channel, so that the workpiece is rotated counterclockwise by an impact of the abrasive grain stream.

3. The sphere precision machining device according to claim 1, wherein a sealing assembly is provided for sealing between docking surfaces of the two hemispheres.

4. The sphere precision machining device according to claim 1, further comprising a control system, a plurality of vibration sensors, and a pressure sensor;

one or more of the vibration sensors are mounted on an inner wall of the cavity for detecting vibration signals generated by the abrasive grain stream;

a pressure sensor is configured to detect the pressure of the abrasive grain stream at an output of the circulation device; and the control system regulates an output pressure of the circulation device in accordance with a vibration signal.

* * * * *